US007444793B2

(12) United States Patent
Raftery et al.

(10) Patent No.: US 7,444,793 B2
(45) Date of Patent: Nov. 4, 2008

(54) METHOD OF CONSTRUCTING A CONCRETE SHEAR CORE MULTISTORY BUILDING

(75) Inventors: Michael Christopher Raftery, Bellevue, WA (US); Mark Russell Garland, Edmonds, WA (US)

(73) Assignee: W. Lease Lewis Company, Seattle, WA (US)

( * ) Notice: Subject to any disclaimer, the term of this patent is extended or adjusted under 35 U.S.C. 154(b) by 693 days.

(21) Appl. No.: 10/801,505

(22) Filed: Mar. 16, 2004

(65) Prior Publication Data

US 2005/0204687 A1 Sep. 22, 2005

(51) Int. Cl.
*E04B 1/00* (2006.01)

(52) U.S. Cl. ..... 52/741.14; 52/79.1; 52/79.14; 52/741.1

(58) Field of Classification Search ..... 52/292, 52/741.1, 83, 79.1, 79.14, 741.14, 741.15, 52/745.02, 745.1, 745.17
See application file for complete search history.

(56) References Cited

U.S. PATENT DOCUMENTS

| | | | | | |
|---|---|---|---|---|---|
| 2,345,500 | A * | 3/1944 | Petter | ..... | 52/73 |
| 3,396,502 | A * | 8/1968 | Contevita | ..... | 52/83 |
| 4,050,213 | A | 9/1977 | Dillon | | |
| 4,231,148 | A * | 11/1980 | Harding | ..... | 29/469 |
| 4,987,719 | A * | 1/1991 | Goodson, Jr. | ..... | 52/742.14 |
| 5,012,627 | A * | 5/1991 | Lundmark | ..... | 52/745.04 |
| 5,669,194 | A | 9/1997 | Colasanto et al. | | |
| 6,530,553 | B1 | 3/2003 | Diorio et al. | | |
| 6,612,083 | B1 | 9/2003 | Richards | | |
| 2002/0026764 | A1 * | 3/2002 | Sachs et al. | ..... | 52/721.1 |
| 2005/0115164 | A1 * | 6/2005 | Han | ..... | 52/79.1 |

FOREIGN PATENT DOCUMENTS

KR 1020020021093 * 4/2002

* cited by examiner

*Primary Examiner*—Richard E. Chilcot, Jr.
*Assistant Examiner*—Mark R Wendell
(74) *Attorney, Agent, or Firm*—Christensen O'Connor Johnson Kindness PLLC

(57) ABSTRACT

Method for constructing concrete shear core buildings wherein a steel erection structure is built having steel columns and beams. The steel erection structure is made from pre-assembled segments that include the steel reinforcing bar for the concrete shear core. A peripheral steel structure is also constructed and the steel floors are built, cooperatively supported by the steel erection structure and the peripheral structure. Forms are positioned generally about the steel reinforcing bars and at least a portion of the steel erection structure. Concrete is poured in the volume defined by the forms, to build a portion of the concrete shear core. In a preferred embodiment, the steel erection structure and peripheral steel structure proceed approximately seven to nine floors ahead of the concrete shear core, and the concrete shear core is sized to support the completed building without accounting for the additional structural support provided by the steel erection structure.

21 Claims, 7 Drawing Sheets

METHOD OF CONSTRUCTING A CONCRETE SHEAR CORE MULTISTORY BUILDING

FIELD OF THE INVENTION

The present invention is in the field of building construction methods and, in particular, to methods for constructing mid- and high-rise buildings.

BACKGROUND OF THE INVENTION

The construction of mid- to high-rise building structures has progressed dramatically over the past decades, with advances in materials, techniques, and analytical methods that enable the economical construction of structurally sound multistory buildings. High-rise structures have many advantages, particularly in an urban setting, including, for example, more productive use of limited land space, economies of scale for building owners and managers, relatively low construction costs per square foot of usable space, attractive and desirable living and/or working space for users, and reduction in urban sprawl for municipalities.

A construction method of choice, particularly in structures more than a few stories tall, utilizes a concrete shear core that functions as a primary structural element for the building. The concrete shear core is essentially a large, hollow, vertical column of reinforced concrete, located generally at an interior location in the building. The concrete shear core typically is a hollow rectangular column that extends along the entire height of the building. The concrete shear core provides a sturdy central structural member that, cooperatively with peripheral columns and transverse beams, reacts to the static and dynamic loads imposed by and on the building. The concrete shear core often houses many of the building services, such as the elevators, utilities, and the like.

Advantages of the concrete shear core construction are well known. For example, in a concrete shear core building, no structural steel bracing or moment connections are required, which are expensive and may interfere with functional and aesthetic aspects of the building. Also, the concrete shear core construction significantly reduces the need for structural steel per square foot of built space, while providing relatively large, column-free tenant space. The concrete shear core provides economic advantages in part because in-place rebar and concrete are cheaper than structural steel. The concrete shear core allows the perimeter structural steel columns to be relatively light, gravity-loaded columns only. The horizontal forces, e.g., forces generated from wind or earthquakes, are resisted substantially by the rigid concrete shear core. A well-designed concrete shear core construction provides a high performance, stiff building that is able to withstand dynamic loads, such as winds and the like, without producing undesirable motion that can be disconcerting to occupants of the building.

There are disadvantages to conventional concrete shear core construction, however. In particular, the construction of a conventional concrete core is relatively time-consuming and has a significant impact on the total time required to complete a building. The time required to complete the construction of a building is extremely important to the overall cost of the building and, therefore, reducing the total construction time is an important goal for controlling the overall cost of construction. The concrete shear core, constructed using conventional methods, typically requires approximately one week per floor to erect. Time-consuming steps required for the concrete shear core construction include moving the forms from floor to floor, setting the reinforcing bars in place (with appropriate overlap at each floor), pouring the concrete, and allowing the concrete to set. The corresponding structural steel and floor construction, in contrast, requires only about two to three days per tier (two floors) to erect. The peripheral structural steel relies on the concrete shear core for support and, therefore, in prior art construction methods, the peripheral steel structure must be erected only after the corresponding portion of the concrete shear core has been completed.

Because the per-floor time required to construct the concrete core is significantly greater than the per-floor time for the steel and floor assembly, often the steel erection work will be performed in stages. For example, after the concrete shear core reaches a desired height, the structural steel and floor work may begin and proceed simultaneously with the concrete shear core construction. When the structural steel construction catches up to the current progress on the shear core, the steelwork must be temporarily halted while the shear core is extended further. When the concrete shear core is completed to a second desired height, a second stage of steel construction may be started. Staging the steel erection work requires mobilization and demobilization of the steel-working equipment and work force, thereby further increasing the cost of construction.

Other disadvantages to conventional concrete shear core construction are that it typically requires rebuilding the core forms at story height transitions or using expensive self-climbing forms, and requires redundant construction equipment, such as temporary stair towers and hoists.

Referring now to FIG. 1, there is depicted a concrete shear core building at an intermediate phase of construction, using prior art construction techniques. In a conventional concrete shear core construction, after the building site is prepared, construction of the concrete shear core 50 begins. As the concrete shear core 50 is extended, forms—for example, plywood forms or so-called "climbing forms" 52—are positioned to define the concrete shear core walls, that is, the volume to be filled with reinforced concrete, typically an annular square cylindrical volume. Steel reinforcing members or rebar (not shown) are then placed vertically in the defined volume. Horizontal steel beams or attaching members 51 are also positioned to be partially embedded in the concrete. Typically, one floor (approximately 10-16 feet in height) is poured at a time. In order to achieve adequate tensile load transfer between vertical sections, the rebar extends above the level that the concrete is to be poured, permitting adjacent floors to have overlapping sections of rebar. An overlapping length of about six feet is typical.

The concrete is then poured to the desired height within the volume defined by the forms 52 and permitted to set. The forms 52 are then moved up to the next floor. This may require the construction of supports for the forms and/or modification of the forms to define the next volume to be filled with concrete. Additional rebar and horizontal support members are then installed, and additional concrete is poured to the next desired height. This process is repeated to complete the concrete shear core. Using conventional methods, it takes about one week to construct one floor of the concrete shear core, depending on the configuration.

Once the concrete shear core is completed to a predetermined height, steel columns 54 are erected generally about the design perimeter of the building and at intermediate locations as required. Horizontal beams (not visible in FIG. 1) are installed between the columns 54 and/or the concrete shear core 50. Corrugated horizontal steel panels are then installed, supported on the beams, and concrete is poured onto the steel panels to define each floor 56. It typically takes approximately two to three days to complete one tier of steel and floor construction. The concrete shear core construction, therefore, is typically a pacing task, directly impacting the time required for constructing taller buildings. If the concrete shear core construction can be accomplished more quickly—for example, at a pace similar to the construction of the steel structure—then the total time required to complete the building may be substantially reduced.

There remains a need, therefore, for a construction method for mid- and high-rise buildings that retains the advantages of the concrete shear core design while improving the speed and efficiency of constructing the concrete core.

SUMMARY OF THE INVENTION

An improved method for building concrete shear core buildings is disclosed that retains the well-known benefits of shear core buildings while overcoming many of the disadvantages, including permitting the concrete shear core to be completed at a pace similar to the pace of constructing the steel framing and floors. The method utilizes a steel erection structure that may be quickly erected and is sized to support multiple floors of the building cooperatively with the steel framing structure. The steel erection structure includes the steel reinforcing bar for the concrete shear core. The floors may be built up—for example, 7 to 9 floors up—before beginning pouring the concrete shear core, and then may be erected at a rapid pace due to the reinforcing bar being already in place, and the steel floors and related structure completed ahead of the concrete core. The steel framing and floors and the concrete shear core, may then proceed at a similar pace, to complete the building. If the concrete shear core is designed to support the building upon completion, without accounting for the additional structural support provided by the steel erection structure, then the steel erection structure provides redundant reinforcing, enhancing the structural integrity of the building.

The improved method includes building a steel erection subassembly including a number of vertical columns, horizontal beams, and rebar, and building peripheral framing structure, also including columns and horizontal beams. One or more of the floor structures may then be installed, cooperatively supported by the steel erection subassembly and the peripheral framing structure. When the structure is built to a desired height, the forms for defining the volume for the concrete shear core are positioned for the first pour, disposed about a portion of the rebar, and the concrete is poured to begin the concrete shear core structure.

In a preferred embodiment, the vertical columns of the steel erection subassembly are disposed between the forms, such that these columns are also substantially embedded in the concrete. The beams may be positioned adjacent the outer forms, such that the concrete flows into the volume defined in the inner side of the beams, thereby further locking the beams into place.

In the disclosed embodiment, the steel erection subassembly is made from a number of pre-assembled segments, each segment having two or more columns connected to two or more beams, and also having a number of steel reinforcing bars attached thereto. These segments are then lifted into place to define a structure, typically a rectangular cylindrical structure, which will define the concrete shear core.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

As discussed in detail below, the present invention is directed to a method for constructing concrete shear core buildings, wherein a central steel erection structure is provided that is adapted to support at least a portion of the peripheral steel structure and floors, such that the structural steel and floor construction may proceed ahead of the concrete shear core. The steel erection structure simplifies the building of the concrete shear core, as discussed in detail below, enabling the construction of the concrete shear core to proceed at a pace similar to the structural steel construction, thereby reducing the time required to erect medium- and high-rise concrete shear core structures.

Figure 2A:
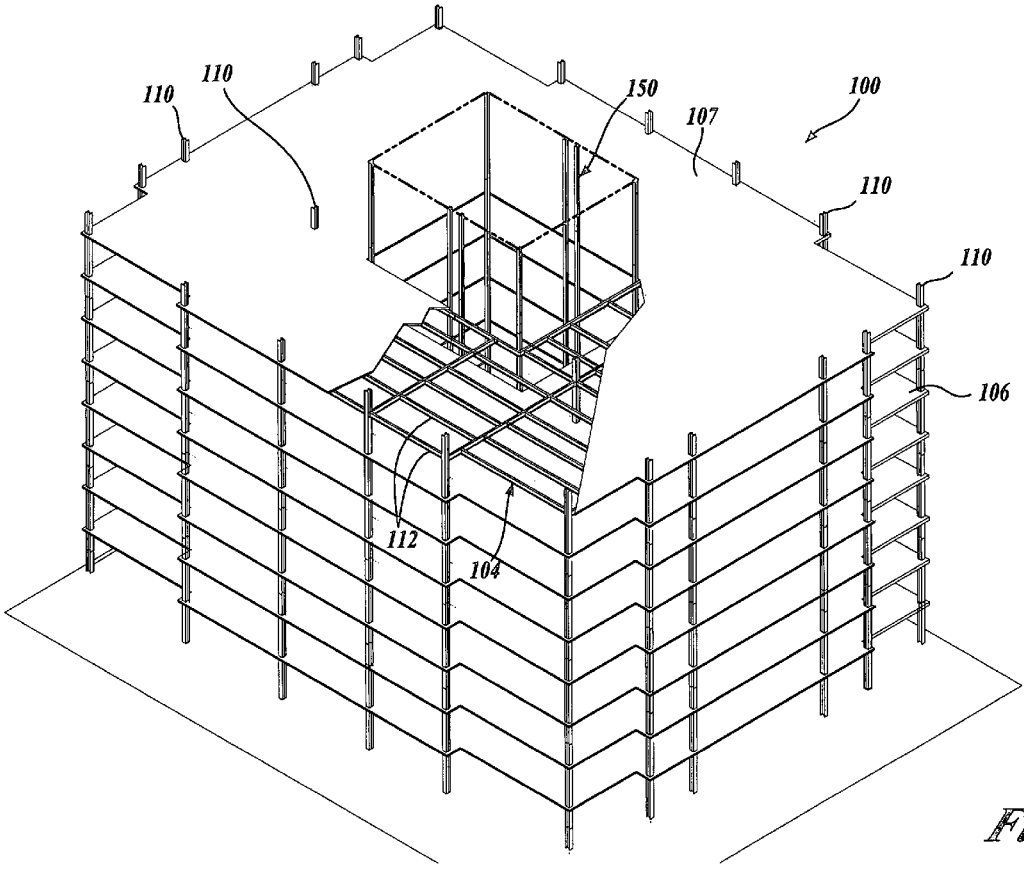
FIG. 2A shows a concrete shear core high rise building at an intermediate state of construction, according to the present invention.

FIG. 2A shows a portion of a steel reinforced concrete shear core building 100 at an intermediate stage of construction and being built according to the teachings of the present invention. At the stage of construction shown in FIG. 2A, approximately nine floors of steel framing 104 and associated steel floors 106 are shown (partially broken away to show details of the framing 104). The steel framing 104 includes a number of peripheral and intermediate structural columns 110 extending vertically and a number of horizontal beams 112 disposed between and fixedly interconnecting the structural columns 110. The steel framing 104 defines a grid-like structure or skeleton for the building. The number of columns 110 and beams 112 will depend on the particular size and design of the building 100, and is determined using well understood engineering principles. The steel framing 104 and steel floors 106 are disposed about a novel steel erection structure 150, which is shown partially in phantom, for clarity.

Figure 2B:
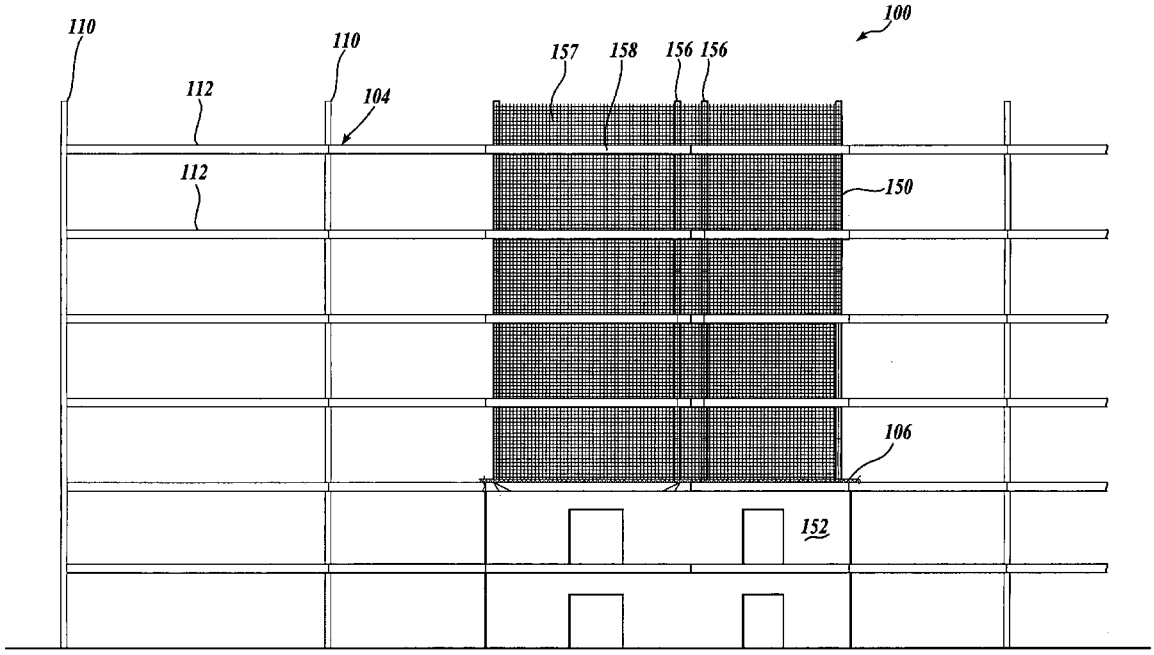
FIG. 2B shows a front view of the partially-completed concrete shear core high rise building of FIG. 2A, with some steel deck and framing removed to expose the shear core.

FIG. 2B shows a front view of the steel reinforced concrete shear core building 100 at a similar intermediate state of construction as FIG. 2A, with some of the steel framing 104 and steel floors 106 removed to expose the partially-constructed concrete shear core 152, and the partially-constructed steel erection structure 150 disposed above the concrete shear core 152. It can now be seen that although the concrete shear core 152 has only been completed to the second floor, the steel erection structure 150 and the steel framing 104, including columns 110 and beams 112, are significantly further ahead in construction.

Figure 1:
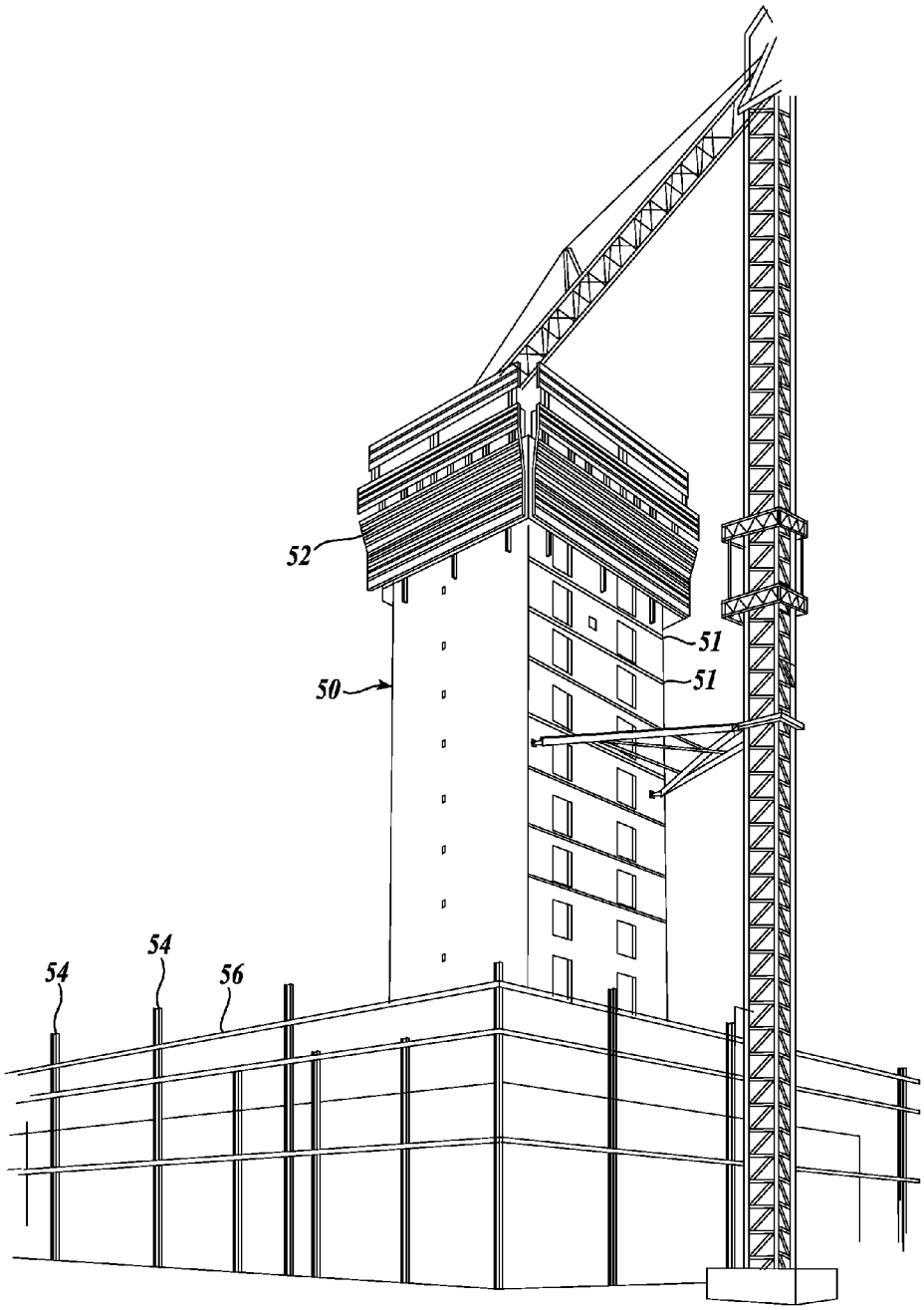
Fig. 1. PRIOR ART
FIG. 1 shows a conventional concrete shear core high rise building at an intermediate stage of construction, using prior art construction techniques.

As can best be seen by comparing FIGS. 2A and 2B with the prior art method shown in FIG. 1, the most striking departure of the method of the present invention from conventional concrete shear core construction techniques is that the steel framing 104 and steel floor 106 construction proceeds ahead of the concrete shear core 152. The steel erection structure 150 temporarily provides the structural support for the building that will be primarily provided by the concrete shear core 152 when the building is completed.

In a preferred embodiment of the method of the present invention, the steel erection structure 150 is sized, with a suitable design margin, to provide sufficient structural support for about ten floors of the building 100 during construction. It is contemplated that the concrete shear core 152 will be conventionally sized to provide the required support for the building 100, and that the steel erection structure 150 will therefore provide redundant support when the building 100 is complete. Alternatively, the steel erection structure 150 may be accounted for to reduce the material requirements in the concrete shear core 152. Although the preferred sizing of the steel erection structure 150 to support approximately ten floors of construction provides certain logistical benefits, it will be readily appreciated that the steel erection structure 150 may alternatively be designed to support more or fewer than ten floors of the building, without departing from the present invention.

In the preferred embodiment, the steel framing 104, disposed outwardly from the concrete shear core 152, and the floors 106 are sized by applying the same engineering principles as would be utilized in the conventional concrete shear core construction method described above with reference to FIG. 1. The steel erection structure 150, however, is disposed at the concrete shear core 152 and provides interim support for the building 100 during the construction period.

Figure 3:
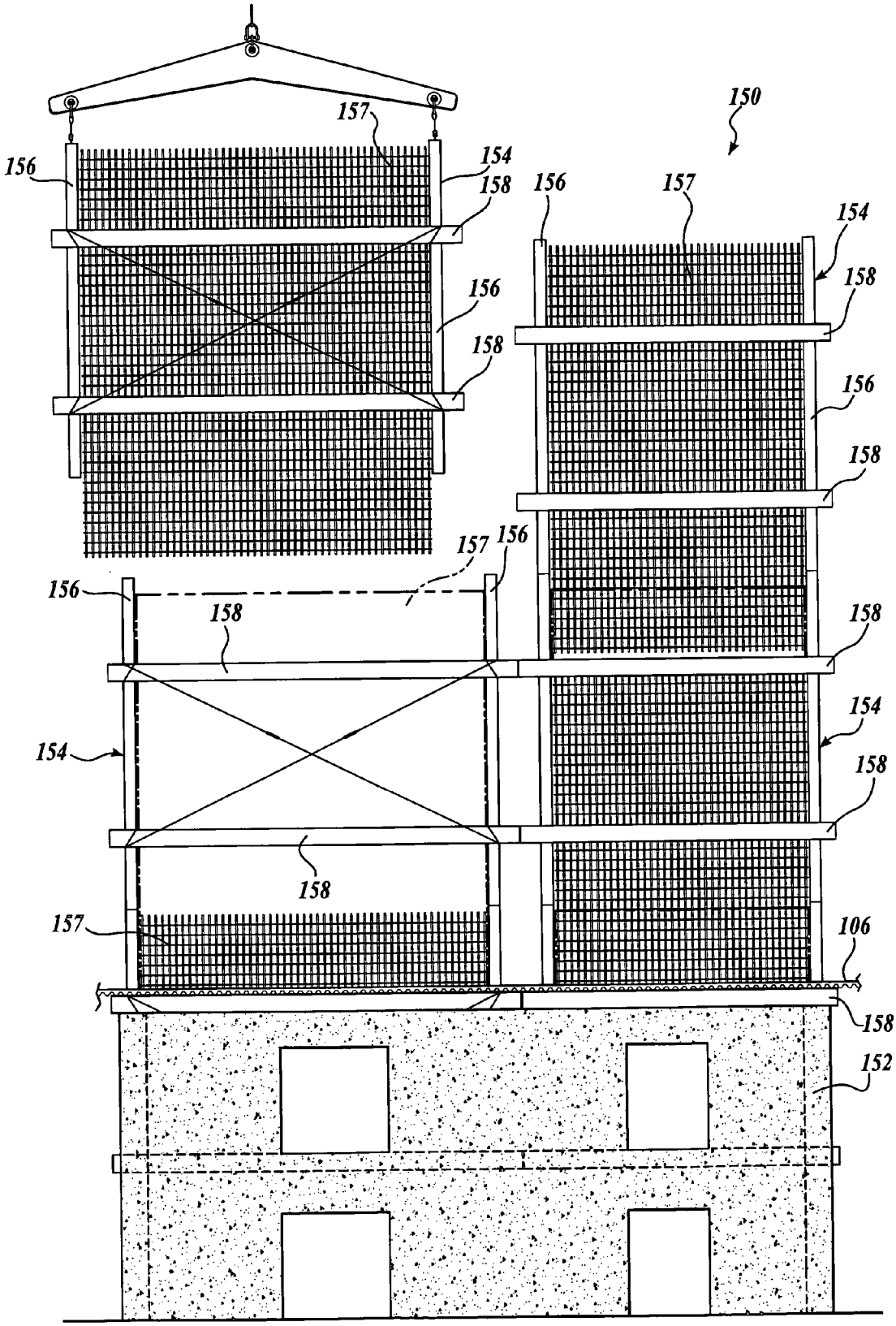
FIG. 3 shows a front view of the shear core shown in FIG. 2B, shown with a portion of the support structure in position to be installed.

FIG. 3 shows a close-up front view of two floors of a partially-constructed concrete shear core 152, and approximately four floors of the steel erection structure 150 disposed thereabove. The steel erection structure 150 is made of a number of segments 154 (four shown) that are preferably pre-assembled on site. In FIG. 3, one segment 154 of the steel erection structure 150 is shown in position for installation. The segments 154 may include two or more vertical columns 156 fixedly attached to two or more horizontal beams 158. A screen of rebar 157 is also fixedly attached to the beams 158 (one screen of rebar 157 is shown in phantom to show overlap portion). The segments 154 are usually two-story (one-tier) structures, and the rebar screens 157 preferably extend approximately six feet below the lower end of the columns 156 in order to overlap the rebar screens 157 immediately therebelow. It will be appreciated that the two-story structure of the segments 154 eliminate one level of rebar 157 overlap, as compared with conventional one-floor construction methods. It is also contemplated that in other applications, each segment may be one to three stories in height.

As shown in FIG. 3, the pre-assembled segments 154 are intended to be lifted as a unit for placement during construction of the steel erection structure 150. The pre-assembled segments 154 are substantial structural components and, in the preferred embodiment, the pre-assembled segments 154 may weigh up to 48,000 pounds. With modern construction methods that enable great precision in the fabrication of structural components such as the pre-assembled segments 154, and due to the relatively rigid framework provided by the columns 156 and beams 158, the pre-assembly of the segments 154 may be accomplished with sufficient precision that aligning and splicing the vertically aligned columns 156 of adjacent segments 154 and overlapping the rebar screens 157 may be accomplished with relative ease.

It should now be appreciated that the assembled segments 154 and, in particular, the columns 156 and beams 158, define a sturdy and rigid structural element that may readily be designed to provide the structural support required for the peripheral steel framing 104 and floors 106 in a manner similar to all-steel buildings, i.e., buildings with a structural steel core rather than a concrete shear core. In the present method, however, the steel erection structure 150 is not designed to support the entire height of the building, but rather, it provides a temporary support during the construction of the concrete shear core 152. The steel erection structure 150 is therefore much less expensive than a steel core designed for an all-steel building.

It will also be apparent to the person of skill in the art that the segments 154 may be erected relatively quickly, as compared to a conventional concrete shear core structure. The utilization of the steel erection structure 150 greatly facilitates construction of the concrete shear core 152 and other portions of the building. For example, placement of the rebar for the concrete shear core using conventional methods is a time-consuming process. Using the present method, the rebar screens 157, pre-assembled into the segments 154, are readily placed. The construction and movement of the forms defining the concrete structure are also simplified, as discussed below. The rebar screens 157 are also preferably two floors in height rather than a single floor, simplifying construction. Finally, it is simpler to build the concrete shear core 152 when the floors above the concrete shear core are already in place, rather than building the tall concrete pillar common in the conventional construction method depicted in FIG. 1.

Figure 4:
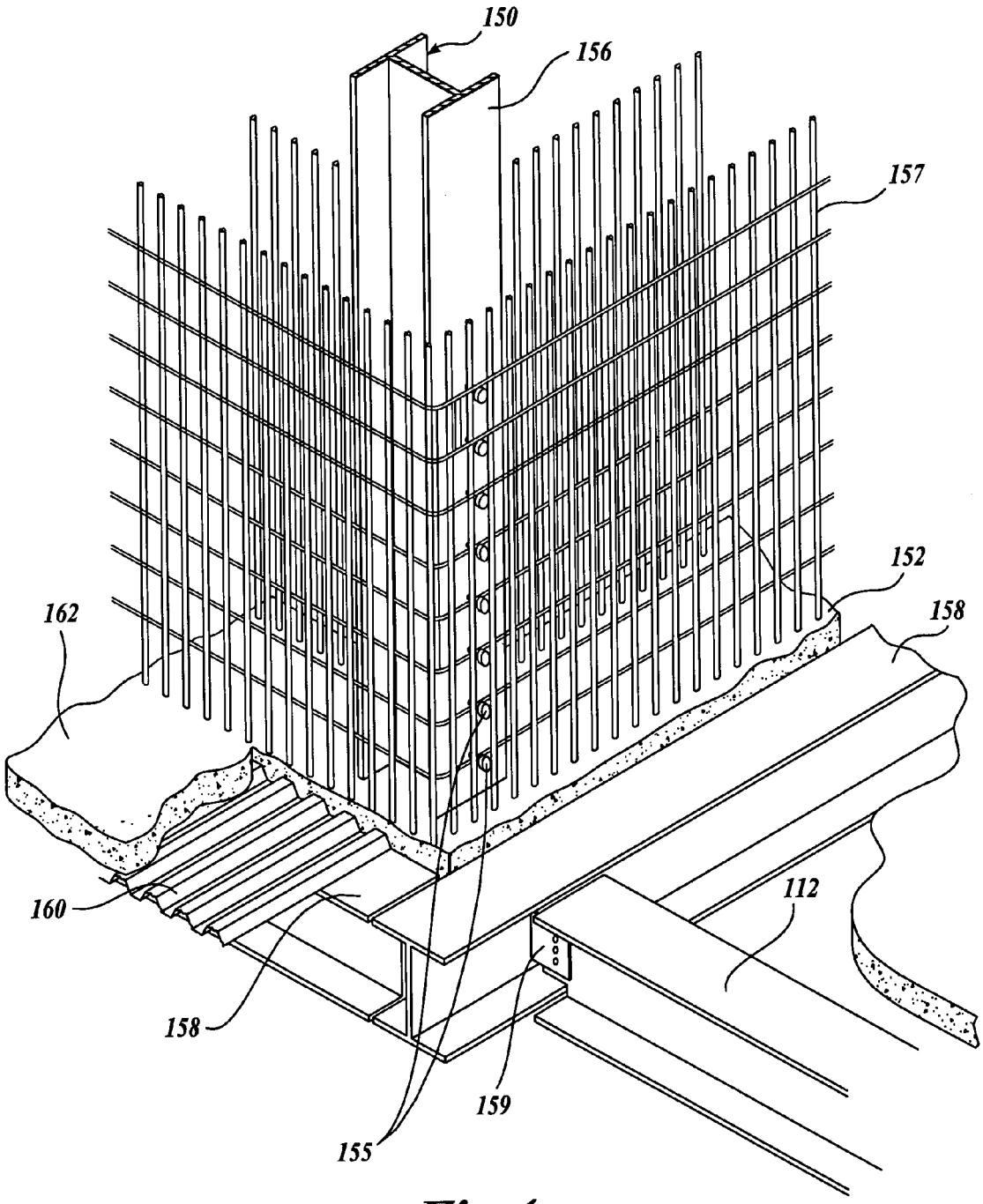
FIG. 4 is a fragmentary perspective view of a corner of the concrete shear core and erection structure shown in FIG. 2B, including a portion of the floor.

FIG. 4 shows a fragmentary perspective view of a corner joint of the steel erection structure 150, with portions of a steel floor panel 160 and concrete floor 162 shown, and with most of the concrete from the concrete shear core 152 removed to show the steel erection structure 150. A pair of horizontal beams 158 (typically, structural wide flange beams) of the steel erection structure 150 abut each other and tie into the beams 112 (one shown) of the steel framing 104 (see FIG. 2A) affixed thereto with connecting tabs 159. The vertical columns 156 (typically, structural wide flange beams) of the steel erection structure 150 are disposed inwardly from the horizontal beams 158. The vertical columns 156 are encased in concrete when the concrete shear core 152 is poured. A plurality of studs 155 may be affixed to the vertical columns 156, as are known in the art, to improve the structural connection to the concrete. The horizontal beams 158 extend outwardly from the concrete shear core 152, providing a structural support for the steel floor panels 160. The steel floor panels 160 conventionally are corrugated, as shown, and designed to support the concrete floor 162.

Figure 5:
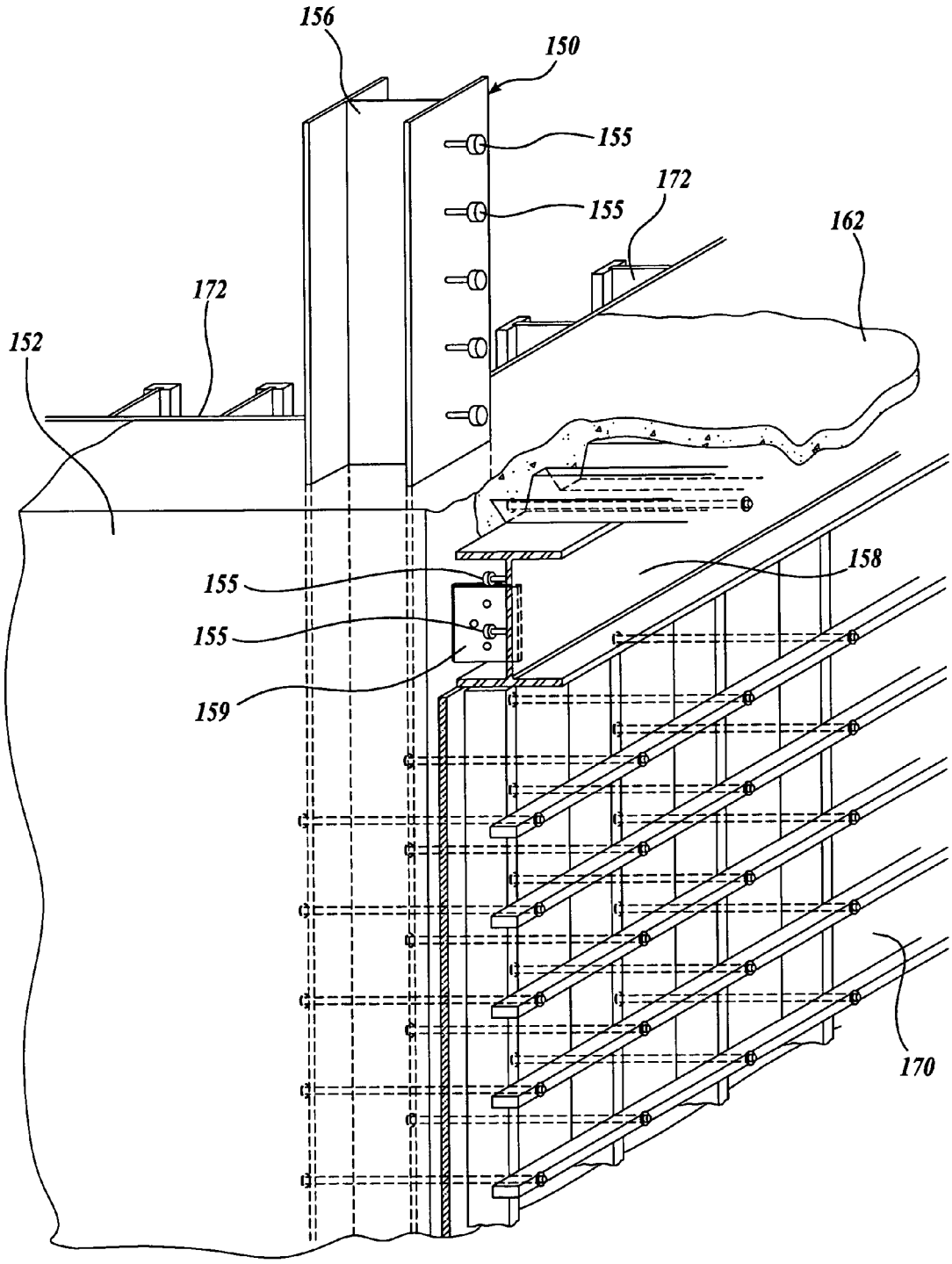
FIG. 5 is a fragmentary perspective view of a portion of the concrete shear core shown in FIG. 2B, with the rebar removed for clarity.

FIG. 5 shows another fragmentary perspective view of a joint in the steel erection structure 150 with the forms 170, 172 in place, and with the rebar screens removed for clarity. An outer form 170, typically a plywood form, is positioned between two horizontal beams 158 (only the upper beam 158 is shown), to define the wall outer surface of the concrete shear core 152. An inner form 172 is similarly disposed to define the wall inner surface of the concrete shear core 152. A connecting tab 159 fixes the horizontal beam 158 to the vertical column 156. A plurality of studs 155 may also be provided on the inner side of the horizontal beams 158. It will be appreciated from FIG. 5 that, although the vertical columns 156 are disposed between the forms 170, 172 and therefore are embedded in the concrete shear core 152, the horizontal beams 158 are not fully embedded in the concrete. Rather, the horizontal beams 158 are positioned such that the concrete at least partially fills the inner space defined by the wide flange horizontal beams 156, thereby further locking the horizontal beams 158 in place on the exterior side of the concrete shear core 152.

Figure 6:
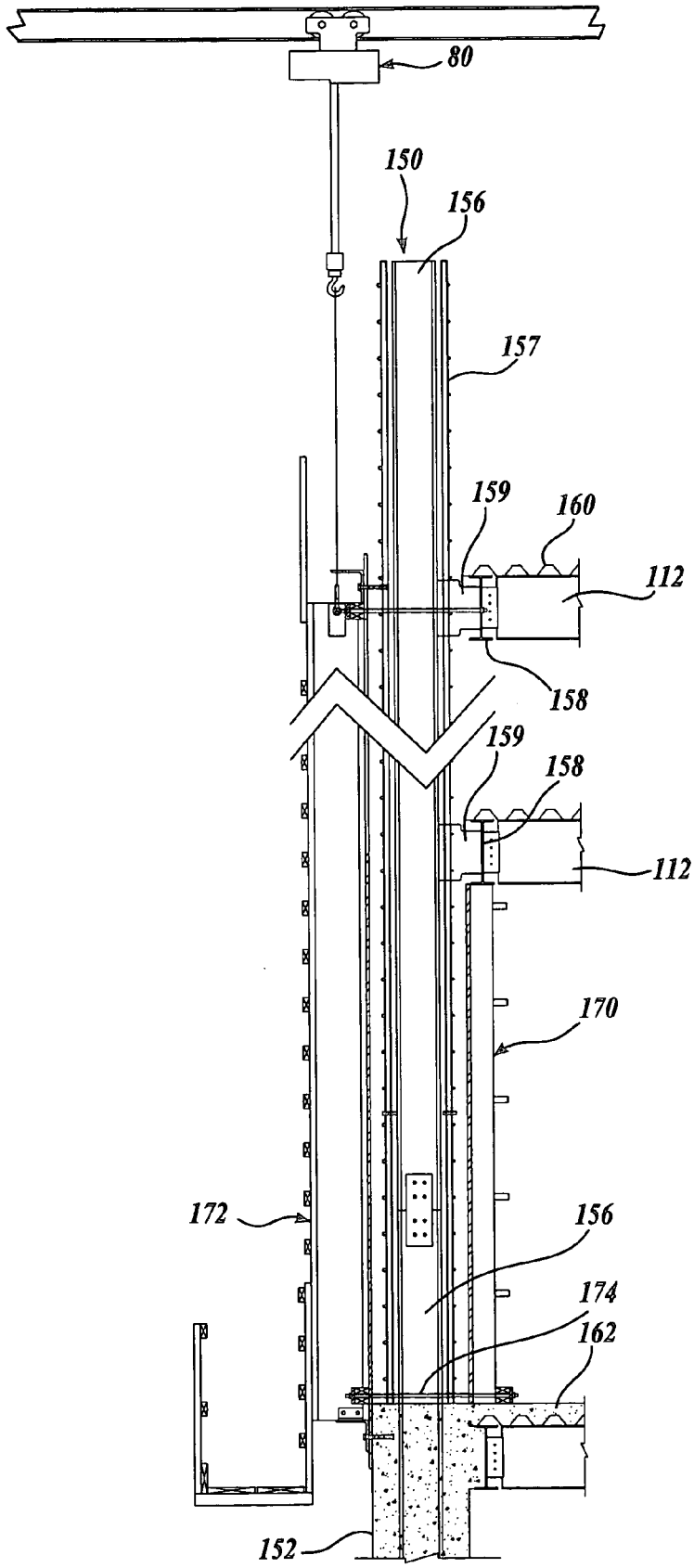
FIG. 6 is a side view of one wall of the concrete shear core shown in FIG. 2B, showing the forms in place.

In the preferred embodiment, the outer forms 170 are approximately one floor in height, such that the outer forms 170 fit between neighboring beams 158. The inner forms 172 are preferably two floors in height. As seen most clearly in FIG. 6, which shows a fragmentary side view of the concrete shear core 152 at an intermediate stage of construction, the outer forms 170 are preferably adapted to fit snugly between the concrete floor 162 of a lower level and the horizontal beam 158 of the next upper level. It will be appreciated by the skilled artisan that an advantage of the present method is that the outer forms 170 may be positioned after the concrete floor 162 has been poured, thereby facilitating placement of the outer forms 170.

The inner forms 172 may be moved, for example, with a hoist 80, to each desired location. A plurality of transverse connecting members 174 interconnects the outer form 170 with the inner form 172, to hold them in place during the concrete pour. It will also be appreciated that with the preferred embodiment of the present method, the inner forms 172 only need to be moved once for every tier of construction.

The steel erection structure 150 of the present invention, therefore, simplifies the construction of the concrete shear core 152 for a number of independent reasons. The present method permits the steel framing and floors to proceed ahead of the concrete shear core 152. The placement of the rebar for the concrete shear core is simplified by pre-assembling the rebar onto the rigid segments 154. The rebar and steel erection structure 150 is two floors in height, reducing the number of rebar placements that must be made by approximately half, and reducing the number of rebar overlaps required. The forms 170, 172 for the concrete pour may be simplified and the inner forms may be two or more floors in height, reducing the number of times they must be moved.

In the preferred method of constructing a concrete shear core building according to the present invention, the construction of the concrete shear core 152 proceeds at a pace that is approximately the same as the pace required to construct the steel erection structure 150, steel framing 104, and steel floors 106. In particular, for a typical high-rise building, it has been found that the concrete shear core 152 can be built at a pace of two floors (one tier) every four days. Although in the preferred method the steel erection structure 150 and the steel framing 104 are constructed approximately seven to nine floors ahead of the concrete shear core 152, it will be appreciated that a greater or lesser gap between the steel structures 150, 104 and the concrete shear core 152 may alternatively be utilized, with suitable structural design of the steel structures 150, 104 according to well-known engineering principles.

It will be appreciated by those of skill in the art, that the present method, wherein the construction of the steel framing 104 and of the floors 106 proceeds ahead of the concrete shear core 152, therefore will be completed earlier in the construction process than in buildings built utilizing conventional methods. This provides a number of additional advantages. For example, the building facing may be started earlier, since the framing is completed earlier. Also, the elevators may come on-line earlier in the construction process, potentially eliminating the need for temporary stair construction, personnel hoists, and the like. The need for self-climbing forms is eliminated, because the steel structure is in place before the concrete must be poured.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for constructing a multistory concrete shear core building comprising the steps of:

erecting a steel erection subassembly for a concrete shear core, the steel erection subassembly including a plurality of preassembled segments, each preassembled segment comprising a first plurality of vertical columns, a first plurality of horizontal beams, and a rebar screen, and wherein erecting the steel erection subassembly includes lifting each of the plurality of preassembled segments as a unit for placement;

erecting a peripheral structural steel subassembly including a second plurality of vertical columns and a second plurality of horizontal beams, the peripheral structural steel subassembly disposed about the steel erection subassembly;

installing a plurality of floor structures that are cooperatively supported by the steel erection subassembly and the peripheral structural steel subassembly;

positioning an inner form and an outer form about the steel erection subassembly such that the inner form and the outer form surround at least a portion of the rebar screen, the inner form and the outer form defining a volume that is adapted to receive a concrete pour; and pouring concrete into the defined volume, such that the concrete and rebar screen form a portion of the concrete shear core for the multistory building.

2. The method of claim 1, wherein the first plurality of vertical columns is disposed at least partially within the volume defined by the inner form and the outer form, whereby the first plurality of vertical columns is at least partially embedded in the concrete after pouring the concrete.

3. The method of claim 2, wherein the steel erection subassembly is sized to cooperatively support at least ten floors of the plurality of floor structures.

4. The method of claim 2, wherein the preassembled segments are approximately two floors in height.

5. The method of claim 4, wherein for each segment the rebar screen is fixedly attached to the at least one horizontal beam.

6. The method of claim 4, wherein the inner forms are at least two floors in height and the outer forms are approximately one floor in height.

7. The method of claim 1, further comprising the step of erecting at least six additional steel erection subassemblies and at least six additional peripheral structural steel subassemblies before pouring concrete into the volume defined by the inner form and outer form.

8. The method of claim 2, wherein the first plurality of horizontal beams are structural wide flange beams, and further, wherein at least some of the first plurality of horizontal beams are positioned adjacent the outer forms such that the concrete poured into the defined volume will lockingly engage at least one side of the horizontal beams adjacent the outer forms.

9. The method of claim 1, wherein the concrete shear core is designed to support the completed multistory concrete shear core building, without accounting for the structural support provided by the steel erection subassemblies.

10. A method for constructing a multistory concrete shear core building comprising the steps of:

building a steel erection structure at least seven floors tall comprising a plurality of preassembled segments, each preassembled segment including a first plurality of vertical columns, a first plurality of horizontal beams, and a plurality of steel reinforcing bars, and wherein building the steel erection structure includes lifting each of the plurality of preassembled segments as a unit for placement;

building a steel framing structure at least seven floors tall, the steel framing structure including a second plurality of vertical columns and a second plurality of horizontal beams;

installing at least one floor structure that is cooperatively supported by the steel erection structure and the steel framing structure;

positioning an inner form and an outer form about the steel erection structure such that the inner form and the outer form surround at least a portion of the steel reinforcing bars, the inner form and the outer form defining a volume that is adapted to receive a concrete pour;

pouring concrete into the defined volume such that the concrete and the steel reinforcing bars form a portion of a concrete shear core for the concrete shear core building;

vertically extending the steel erection structure and the steel framing structure;

repositioning the inner form and the outer form to define a second volume directly above the first volume; and pouring concrete into the second volume, thereby vertically extending the concrete shear core.

11. The method of claim 10, wherein the first plurality of vertical columns is disposed at least partially within the volume defined by the inner form and outer form, whereby the first plurality of vertical columns is at least partially embedded in the concrete after pouring the concrete.

12. The method of claim 11, wherein the steel erection structure is sized to cooperatively support about ten floors of the floor structure.

13. The method of claim 11, wherein the plurality of preassembled segments comprise one-tier segments.

14. A method for constructing a multistory concrete shear core building comprising the steps of:

preassembling a plurality of steel erection segments, each steel erection segment having a first plurality of vertical columns, a first plurality of horizontal beams, and a plurality of steel reinforcing bars;

building a steel erection subassembly by lifting each of the plurality of steel erection segments as a unit for placement and assembling the plurality of steel erection segments into a substantially rectangular column;

building a peripheral structural steel subassembly including a second plurality of vertical columns and a second plurality of horizontal beams;

installing at least one floor structure that is cooperatively supported by the steel erection subassembly and the peripheral structural steel subassembly;

positioning an inner form and an outer form about the steel erection subassembly such that the inner form and outer form surround at least a portion of the plurality of steel reinforcing bars, the inner form and outer form defining a volume that is adapted to receive a concrete pour; and pouring concrete into the defined volume such that the concrete and the plurality of steel reinforcing bars form a portion of a concrete shear core for the concrete shear core building.

15. The method of claim 14, wherein the first plurality of vertical columns is disposed at least partially within the volume defined by the inner form and the outer form, whereby the first plurality of vertical columns is at least partially embedded in the concrete after pouring the concrete.

16. The method of claim 15, wherein the steel erection subassembly is sized to cooperatively support at least ten floors of the floor structure.

17. The method of claim 15, wherein the preassembled segments are approximately two floors in height.

18. The method of claim 17, wherein the inner forms are at least two floors in height and the outer forms are approximately one floor in height.

19. The method of claim 14, further comprising the step of building at least six additional steel erection subassemblies and at least six additional peripheral structural steel subassemblies before pouring concrete into the volume defined by the inner form and outer form.

20. The method of claim 15, wherein the first plurality of horizontal beams are structural wide flange beams, and further, wherein at least some of the first plurality of horizontal beams is positioned adjacent to the outer forms such that the concrete poured into the defined volume will lockingly engage the wide flange beam.

21. The method of claim 14, wherein the concrete shear core is designed to support the completed multistory concrete shear core building, without accounting for the structural support provided by the steel erection subassemblies.

* * * * *